US006295689B1

(12) United States Patent
Sciacca

(10) Patent No.: US 6,295,689 B1
(45) Date of Patent: Oct. 2, 2001

(54) WIPE-DOWN KNIFE

(76) Inventor: Phillip George Sciacca, 9343 RiverOaks La., Orangevale, CA (US) 95662

( * ) Notice: Subject to any disclaimer, the term of this patent is extended or adjusted under 35 U.S.C. 154(b) by 0 days.

(21) Appl. No.: 09/204,744

(22) Filed: Dec. 2, 1998

(51) Int. Cl.[7] ..... A47L 1/06
(52) U.S. Cl. ..... 15/245.1; 15/143.1; 15/144.2
(58) Field of Search ..... 15/143.1, 144.1, 15/144.2, 235.9, 235.8, 245, 245.1

(56) References Cited

U.S. PATENT DOCUMENTS

| | | | | |
|---|---|---|---|---|
| 1,057,947 | * | 4/1913 | Dietz | 15/245 |
| 2,804,637 | * | 9/1957 | Antozak | 15/144.1 |
| 3,069,713 | | 12/1962 | Obraske . | |
| 3,766,591 | * | 10/1973 | Soito | 15/245 |
| 3,803,662 | * | 4/1974 | Glejf | 15/245.1 |
| 4,520,527 | * | 6/1985 | Maggio et al. | 15/144.2 |
| 5,261,144 | * | 11/1993 | Mitchell et al. | 15/245.1 |
| 5,347,676 | * | 9/1994 | Saitoh | 15/245 |
| 5,528,793 | * | 6/1996 | Schbot | 15/245 |
| 5,580,608 | | 12/1996 | Capoccia . | |
| 5,930,863 | * | 8/1999 | Samuelsson | 15/245.1 |

FOREIGN PATENT DOCUMENTS 4447503 11/1995 (DE) .

* cited by examiner

*Primary Examiner*—Terrence R. Till
(74) *Attorney, Agent, or Firm*—Audrey A. Millemann; Joseph E. Gerber

(57) ABSTRACT

The wipe-down knife herein is assembled upon an elongate handle, one end of which is fitted with a generally cylindrical blade-supporting head. The head has a collar and lever arm on one end for securely engaging the handle shaft, and a pair of closely opposed pads and a pivot pin on its other end for engaging a blade-supporting plate. A bracket which grasps the blade at its base is affixed to the blade-supporting plate. The blade is wide and flexible, projecting from the blade support at a right angle to the longitudinal axis of the knife's handle. The blade curves away from the blade-supporting bracket at a right angle, such that the plane of the blade's working edge is parallel with the handle's longitudinal axis.

22 Claims, 10 Drawing Sheets

WIPE-DOWN KNIFE

BACKGROUND OF THE INVENTION

1. Field of the Invention

The present invention relates generally to hand tools for smoothing-out pastey and plastic substances on planar surfaces, and more specifically to wipe-down knives for smoothing wet plaster and other finishing compounds during drywall construction.

2. Description of the Related Art

In the phase of residential and commercial building construction in which the interior wall surfaces are applied to supporting studs, sheet rock panels are nailed or screwed to the studs and then the seams therebetween are taped-over and plastered. After tape and plaster are applied to the seams, the surface of each seam must be wiped-down to give it a finished surface appearance and to prepare it for the application of paint.

The wipe-down phase of drywall construction is commonly carried out with the use of a short hand trowel. However, using a hand trowel for wipe-down purposes has many drawbacks. For example, most hand trowels have a relatively short blade which requires the user to make multiple horizontal passes back and forth across the seam to yield a ridge-free seam surface appearance. Further, on walls where the ceiling height is over eight feet, or so, the user must climb upon a ladder, scaffold or other apparatus to reach and wipe-down the seams.

Various long-handled trowels have been proposed, but these are generally clumsy and more difficult to control as their handles get longer. And, despite their long handles, it is difficult to apply the blade of a long-handled trowel to a wall surface at the proper angle to smooth-out plaster.

The apparatus of U.S. Pat. No. 4,817,229 issued to Sedillo in 1989, comprises a swiveling, short-edged, semicircular-shaped trowel blade on a long handle pole for wiping-down high seams. Sedillo's apparatus attempts to address the problem of achieving the correct blade-to-wall angle when using a long-handled trowel, but it is difficult to use and lacks the durability the journeyman drywall specialist would normally expect of his or her tools. Further, Sedillo's short blade makes it necessary to use a great many individual strokes in smoothing out a plaster surface. This makes it difficult to avoid telltale ridges between strokes.

Several long-bladed trowels have been proposed for the purpose of reducing the number of strokes required to finish a plaster surface. However, those constructed of metal are too heavy and not sufficiently flexible because, when thinner sheets of metal are used, these tend to deform upon being bolted as securely as necessary to an elongate blade-supporting bar. Securely bolting a thin metal blade along one edge tends to warp the opposing edge and make it wavy; this results in a wavy pattern in the plaster surface being worked. The same has been found in experimenting with over-sized plastic blades.

Thus, it appears that a need exists for a wipe-down knife fit for use in all drywall seam-finishing operations, no matter the height of the wall being finished.

SUMMARY OF THE INVENTION

The wipe-down knife of the present invention is adapted to overcome the above-noted shortcomings and to fulfill the stated needs. It is assembled upon an elongate handle, one end of which is fitted with a generally cylindrical, blade-supporting head. The head has means on one end for securely engaging the handle shaft and means on its other end for engaging blade-supporting apparatus. The blade support comprises a plate and bracket which grasp the blade at its base. The blade is wide and flexible, projecting from the blade support at a right angle to the longitudinal axis of the knife's handle, and curving roughly 90 degrees such that the plane of its working edge is parallel with the handle's longitudinal axis.

It is an object of the present invention to provide a wipe-down knife that is easier to use than earlier tools in finishing drywall in high-ceilinged rooms.

It is a further object of the present invention to provide a wipe-down knife that is more versatile and durable than earlier tools available to the drywall specialist.

Still a further object of the present invention is to provide a wipe-down knife having interchangeable parts of different sizes, so that the drywaller needing a tool having a shorter or longer handle, or a wider or narrower blade, is able to adapt the tool with an interchangeable part best suited to his or her immediate purpose.

Another object of this invention is to provide a blade-supporting assembly for an over-sized wipe-down knife blade which assures that the working edge remains straight and waveless.

Yet another object of this invention is to provide a long-handled tool with an adjustable, flexible blade suited to many different purposes in a wide array of skills, tasks, industries, professions and arts.

Still further objects of the inventive wipe-down knife disclosed herein will be apparent from the drawings and following detailed description thereof.

DESCRIPTION OF THE PREFERRED EMBODIMENT

Figure 1:
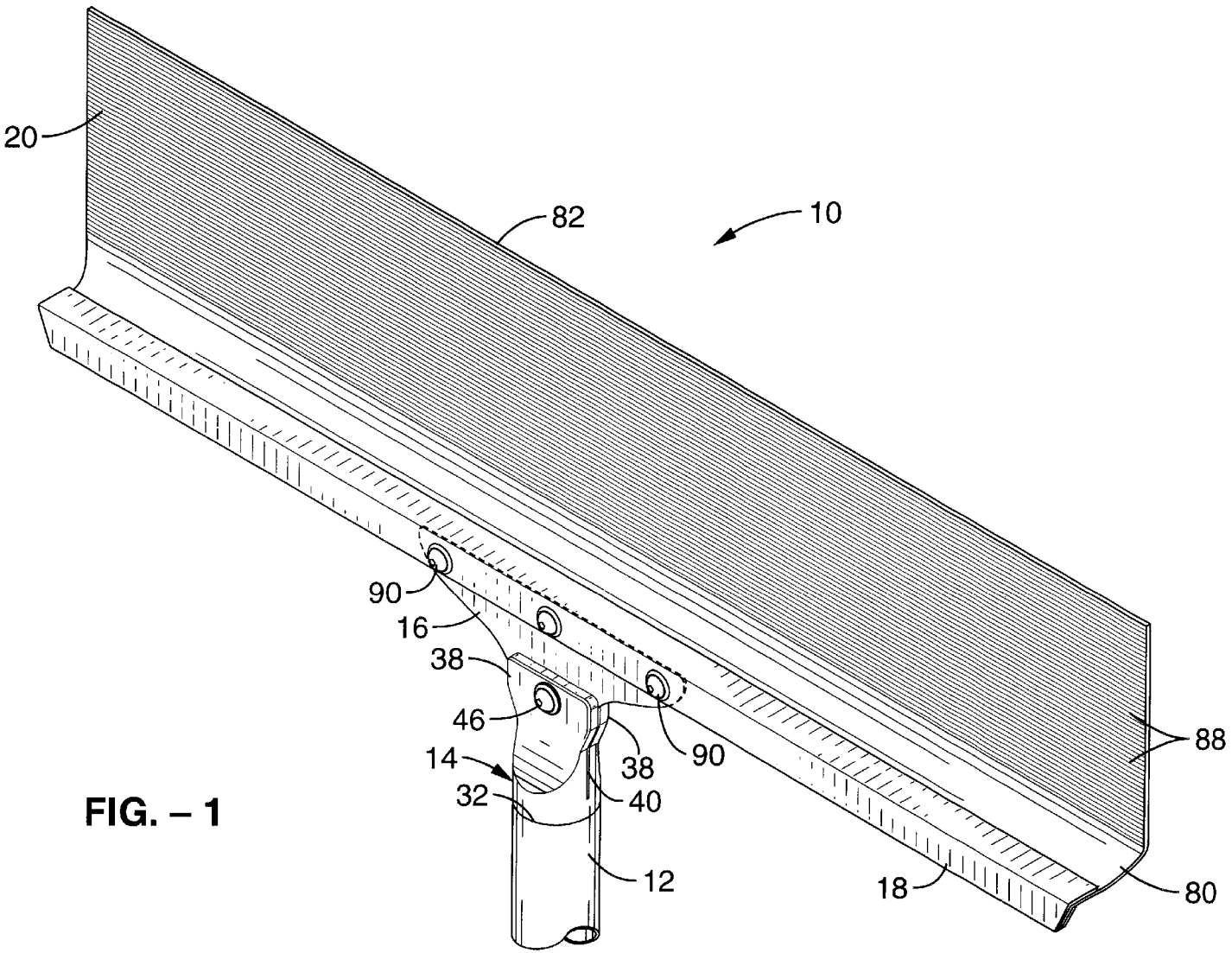
FIG. 1 is a perspective view of the wipe-down knife of the invention.

Referring now specifically to the drawings, FIGS. 1 through 6A and 6B show a first embodiment of the inventive wipe-down knife, which is generally identified herein with the reference numeral 10.

Wipe-down knife 10 is assembled from five primary components: handle shaft 12; head 14; blade-mounting plate 16; blade base-grasping bracket 18; and, blade 20.

Handle shaft 12 is preferably fashioned from a straight length of tubular aluminum stock, roughly 1.375 inches in diameter, and 0.035 inch thick. The length of handle shaft 12 will commonly be approximately two feet, or so. However, when a longer reach is required, as when ceilings are higher than about 10 feet, greater lengths of tubular stock may be employed in the construction of handle shaft 12. Likewise, for jobs in tight spaces or of minimal height, handle shafts one foot, or less, may suffice. It is also contemplated that multiple, interchangeable, different-length handle shafts 12, each having inside and outside diameters identical to the others may be kept at the ready to meet differing needs as they arise. Each such handle shaft 12, having inside and outside diameters equal to all others, would mate equally well with head 14. It is further contemplated that handle shaft 12 may be comprised of a plurality of separate lengths of tubular stock, each being able to be securely bound to the next with a connector or adapter (not shown), many types of which are well known in the art. Such subunits employed to create a handle shaft of custom length may be of equal or unequal length. The terminal end of handle shaft 12, opposite the end which receives head 14, may be fitted with any of a variety of known plugs or covers (not shown). Alternative handle shaft constructions comprised of different materials, such as steel or plastic, are also envisioned. Further, a handle shaft having a solid body throughout, but having a hollow end able to receive head 14, would also likely work satisfactorily.

Figure 7:
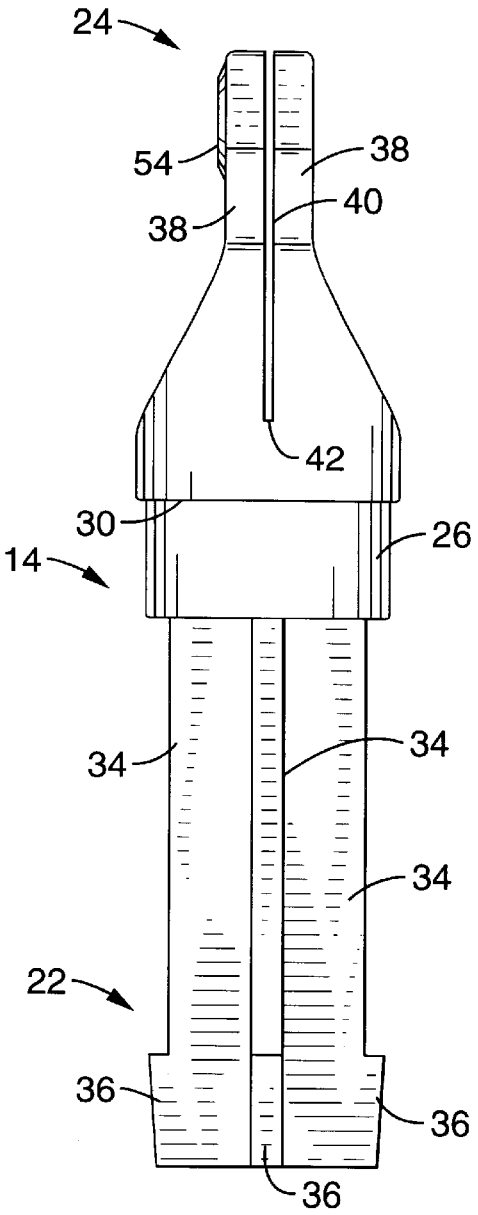
FIG. 7 is a side elevational view of the entire head portion of the wipe-down knife of the invention.

Head 14 is a unitary structure having an elongate, generally cylindrical shape, with a diameter approximately the same as the outer diameter of handle shaft 12. Head 14 is shown separately in FIGS. 7 and 8.

Head 14 is constructed of durable, molded plastic. A combination of polypropylene mixed with 30–40% glass fiber has been found to yield a sufficiently durable product. However, it is contemplated that head 14 may be made from other rigid substances, such as metal, and some woods.

The rearward portion of head 14 is adapted to engage the open end of handle shaft 12, and the forward portion is adapted to have blade-mounting plate 16 affixed thereto. These opposed portions or ends of head 14 are identified herein with reference numerals 22 and 24, respectively. Handle-engaging portion 22 of head 14 comprises roughly two-thirds of head 14's length and is comprised of two primary components, tapered collar 26 and lever arm 28.

Tapered collar 26 is a frustoconically-shaped structure, tapered such that its diameter decreases from handle end edge-abutting step 30 toward handle-engaging end 22 of head 14. Collar 26's largest diameter is directly adjacent abutting step 30, where it is preferably the same diameter as, or slightly larger than, the inside diameter of handle shaft 12. The diameter of collar 26's smaller end is preferably about 0.003 inch less than collar 26's larger end. Ultimately, collar 26 should be shaped and dimensioned such that, when inserted into the open end of handle shaft 12 and driven in an axial direction toward the handle's opposite end, collar 26 seats snugly in secure frictional engagement with the inside wall of handle shaft 12 immediately adjacent its end edge. Collar 26 should reach its most secure fit within handle shaft 12 just as the end edge 32 of handle shaft 12 approaches and abuts handle end edge-abutting step 30. The depth of step 30, from the uniform diameter of the cylindrical portion of head 14's blade-mounting portion 24, to the diameter of the largest portion of collar 26 is approximately 0.035 inch, the same thickness as the tube stock from which handle shaft 12 is fashioned. And, the diameter of blade-mounting portion 24 of head 14 is the same as the outside diameter of handle shaft 12. Thus, when collar 26 of head 14 is fully seated within the open end of handle shaft 12, and when handle shaft 12's end edge 32 abuts step 30, a relatively unbroken, cylindrical surface of uniform diameter from handle shaft 12 through to blade-mounting portion 24 of head 14 results.

Figure 8:
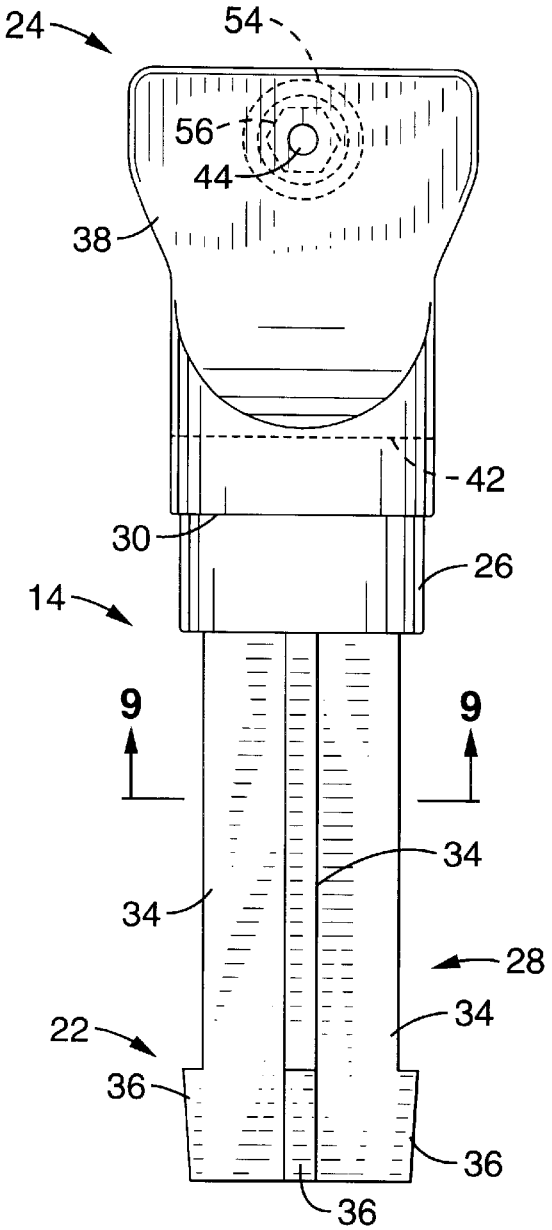
FIG. 8 is a front elevational view of the head portion shown in FIG. 7.
Figure 9:
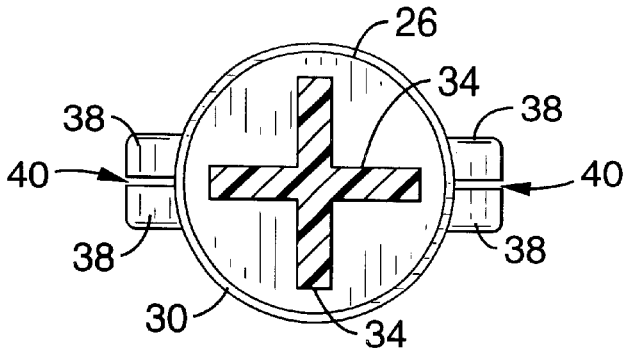
FIG. 9 is a cross-sectional view of the head of FIG. 7, taken on line 9—9 thereof.

Lever arm 28 of head 14 seats deeper within handle shaft 12 than collar 26. As shown in FIGS. 8 and 9, lever arm 28 is cruciform in cross-section, being comprised of four elongate, equally-dimensioned, generally rectangular components 34, each rectangular component 34 projecting radially at a right angle to its two most closely adjacent components 34. Each rectangular component also bears a radially-projecting shoe 36 on its outermost, endmost edge. Each shoe 36 is slightly tapered in a manner which causes a cross-section taken closer to the end of lever arm 28 to have a smaller width than a cross-section taken farther from lever arm 28's end. Lever arm 28's maximum width, including shoes 36, should be the same or slightly less than the inside diameter of handle shaft 12, such that it slides easily but snugly into handle shaft 12 and seats securely therein.

Head 14's tapered collar 26 and lever arm 28 cooperate to keep head 14 securely seated within the end of handle shaft 12. As force is directed in a radial direction against the blade-mounting end 24 of head 14, as commonly occurs in the normal use of wipe-down knife 10, collar 26 acts as a fulcrum and lever arm 28's shoes 36 brace against the opposite portion of inner surface of handle shaft 12 deep within its length.

Head 14's blade-mounting portion 24 is uniformly cylindrical near step 30. But, moving forward, blade-mounting portion 24 loses its radial symmetry and flattens out into a pair of identical, projecting, paddle-like pad 38 of a width somewhat greater than the diameter of the rest of head 14. Pads 38 are of equal thickness; and, they are parallel and closely opposed to one another, such that a deep, planar slot 40 of uniform width is defined therebetween. Slot 40 is parallel to head 14's longitudinal axis. The depth of slot 40 is preferably such that its bottom edge 42 resides at about the point where the cross-section of head 14's blade-mounting portion transforms from a circular toward a flattened shape.

Figure 6A:
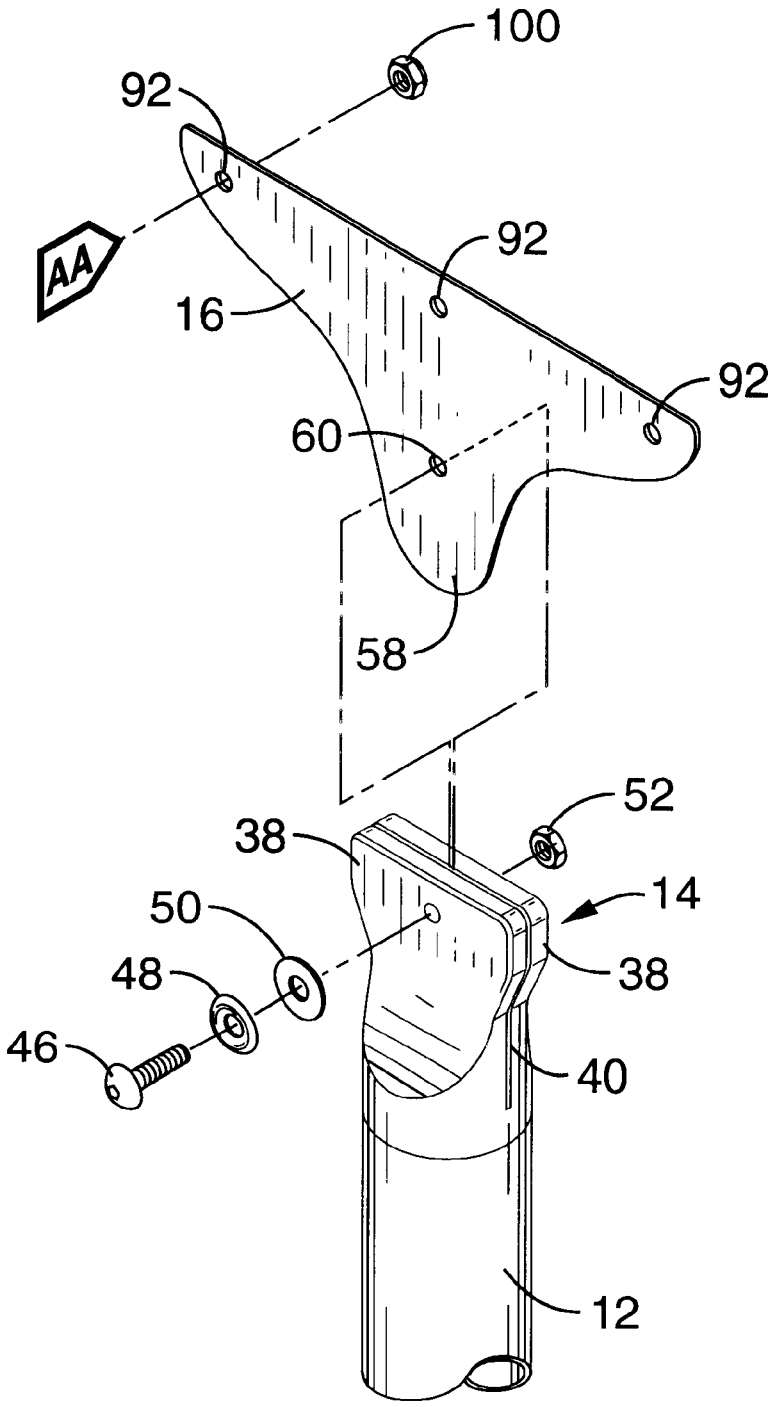
FIG. 6A is an exploded, partial, perspective view of the head and blade-mounting plate of the wipe-down knife of the invention.
Figure 6B:
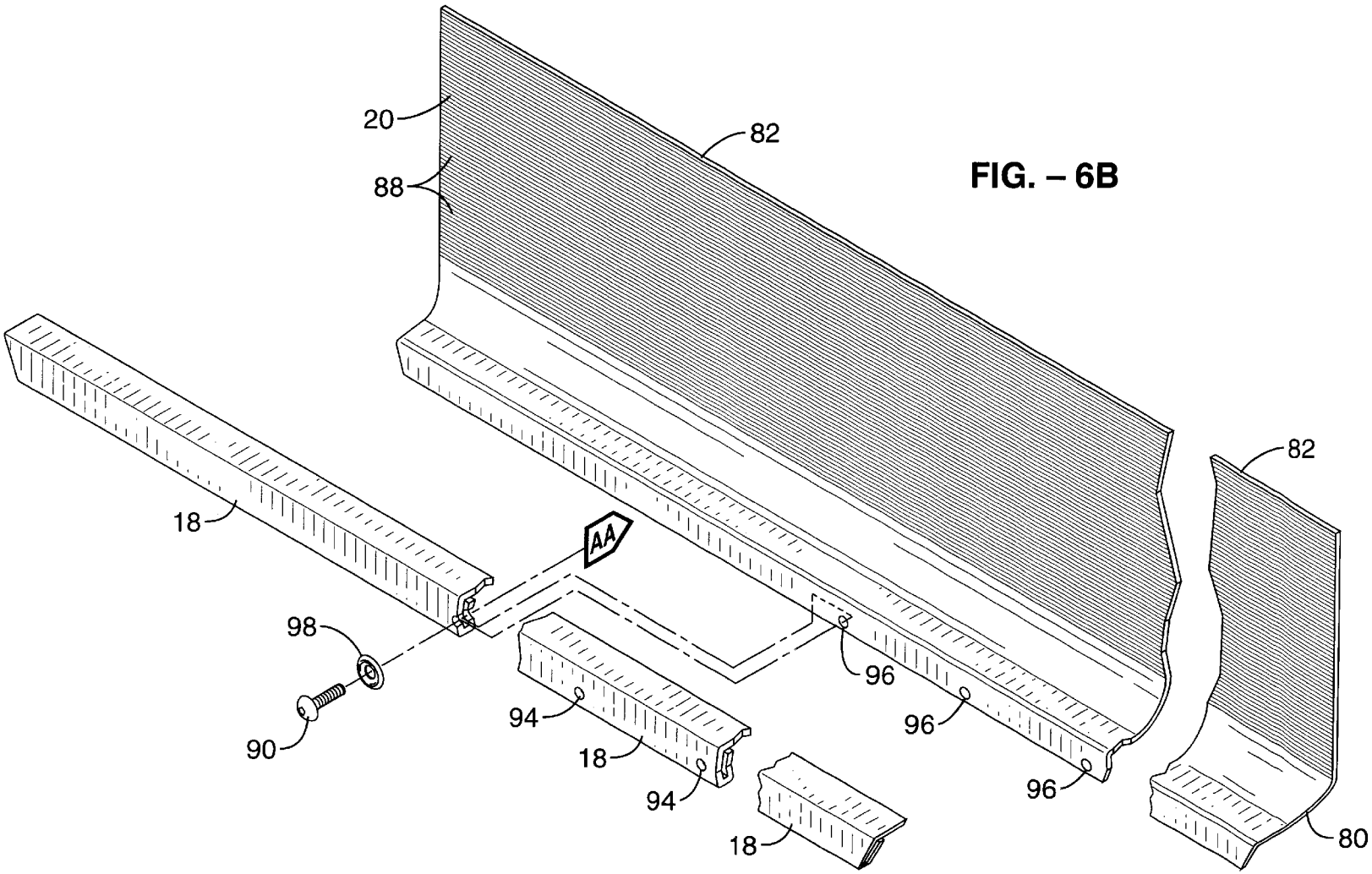
FIG. 6B is an exploded, partial, perspective view, continuing from FIG. 6A, showing the blade and blade base-grasping bracket of the wipe-down portion of the invention.

Each flattened pad 38 includes a centrally-placed, transverse aperture 44. Apertures 44 are aligned with one another such that a pivot pin 46 may be passed therethrough to span slot 40 in a direction perpendicular to head 14's longitudinal axis. Pivot pin 46 must include some means for drawing pads 38 toward one another, thus narrowing slot 40, and for fixing pads 38 in place in their movement toward one another. Thus, pivot pin 46 may conveniently be a common fastener such as a machine screw, or the like, employed with cooperating, domed, compression washer 48 (also sometimes referred to as a button washer) ; flat washer 50; and, hex nut 52. This is shown in FIG. 6A. The length of pivot pin 46 should be sufficient to permit it to pass through both adjacent pads 38 as well as to permit a portion of its threaded end to project beyond the outer face of the pad 38 opposite that where the head of pivot pin 46 is seated. As the machine screw of pivot pin 46 is tightened, compression washer 48 tends to exert back-pressure against the screw's head and against flat washer 50, thus tending to hold the machine screw in position and keep it from loosening during use. Thus, compression washer 48 serves a tension-retaining function in the operation of pivot pin 46.

For convenience in tightening pivot pin 46, one pad 38 may include boss 54 surrounding its aperture 44, wherein boss 54 includes a hex-shaped cutout 56 for receiving and retaining hex nut 52. This is best viewed in FIGS. 7 and 8.

Slot 40 receives planar, T-shaped, rigid blade-mounting plate 16. Blade-mounting plate 16 is constructed from rigid metal stock, preferably aluminum, having a thickness which permits plate 16 to be slidingly received in slot 40 with slight friction from the inner surfaces of both flattened pads 38. Blade-mounting plate 16's central lobe 58 includes pivot pin aperture 60. Aperture 60 is preferably located deep enough within the planar surface of blade-mounting plate 16, i.e. as far as possible from its outer edges, such that a substantial amount of surface area surrounds aperture 60 on all sides. This is to assure that, when blade-mounting plate 16 is assembled with head 14 by passing pivot pin 46 through apertures 44 and aperture 60 as shown in FIG. 6A, there is sufficient surface area of the inner faces of pads 38 in contact with the surfaces of blade-mounting plate 16 to permit plate 16 to be securely grasped by pads 38 and held in any desired position.

The force with which pads 38 impinge upon blade-mounting plate 16 is adjustable by turning the screw head of pivot pin 46. As desired, pads 38 may be drawn tightly toward one another to grasp plate 16 very firmly, or they may be loosened to permit plate 16 to pivot freely side-to-side in slot 40. However, ideally, pivot pin 46 should be tightened to a point which permits plate 16 to retain a fixed position under normal working conditions, but which permits the position of plate 16 in slot 40 to be changed at will by the user, without the need to resort to turning the screw head or otherwise adjusting the tension with which pivot pin 46 draws pads 38 toward one another. Thus, pads 38 and pivot pin 46 of head 14's blade-mounting end 24 cooperate to function as an adjustable yoke, fixing blade-mounting plate 16 inextricably in slot 40 such that plate 16 is rotatable through a wide, planar arc, yet permitting plate 16's position to be fixed at any desired point throughout that arc.

Blade base-grasping bracket 18 is an elongate structure oriented transverse to the longitudinal axis of wipe-down knife 10, as established by handle shaft 12. That is, bracket 18's own longitudinal axis is perpendicular to the longitudinal axis of handle shaft 12. Bracket 18 has a generally L-shaped cross-section adapted to engage the base of blade 20 and to cooperate with blade-mounting plate 16 as a blade support structure. Bracket 18 is comprised of a first planar panel 62 projecting in a first plane perpendicular to bracket 18's longitudinal axis, and a second planar panel 64, integral with first panel 62 at a common apex 66, projecting in a second plane perpendicular to bracket 18's longitudinal axis. The second plane in which second planar panel 64 resides is also generally perpendicular to the plane in which first panel 62 resides. First and second panels 62 and 64 are preferably integral with one another; i.e., bracket 18 is preferably a unitary structure.

Closer examination of bracket 18 reveals that second panel 64 projects farther from apex 66 than first panel 62, and that second panel 64 is folded back upon itself toward the interior angle 68 of apex 66. The folded-back portion 70 of the farther-projecting second panel 64 is parallel to, but spaced apart from, the primary, base portion 72 of second panel 64 which is closer to apex 66. Thus, a slot-shaped space 73 is defined between the folded-back portion 70 of second panel 64 and the primary, base portion 72 thereof. However, the terminal end edge 74 of folded-back portion 70 falls short of abutting first panel 62, thus leaving the opening necessary for nesting the base of blade 20 within bracket 18.

Satisfactory results have been achieved from a bracket 18 constructed of polycarbonate plastic, although now-known or later-discovered materials may work as well or better in performing the function of this element of the invention.

Blade 20 is constructed from a substantially rectangular sheet of polycarbonate plastic approximately 0.070 inch thick. Once molded into its permanent working form, blade 20's shape is best described from the viewpoint of looking at its side edge, as in FIG. 3, as it is from this view that the majority of blade 20's salient features may be viewed. This is adequate, as all surfaces of blade 20 have a straight axis which is substantially parallel to the length of blade base-grasping bracket 18.

Overall, blade 20 has a generally L-shaped cross-section. Blade 20 has an anchor tab 76 at its base which is received securely within the slot-shaped space 73 between the folded-back portion 70 and the primary, base portion 72, of second panel 64. A right-angled nesting portion 78 of blade 20 directly adjacent to anchor tab 78 is adapted to seat nestingly against interior angle 68 of blade base-grasping bracket 18's apex 66. Immediately adjacent to nesting portion 78, and farther from anchor tab 78, blade 20 has a curved hinge portion 80. Curved hinge 80 comprises an arced bend of approximately 90 degrees. The working edge portion 82 of blade 20 projects straight away from curved hinge 80, and extends therebeyond for several inches.

Figure 4:
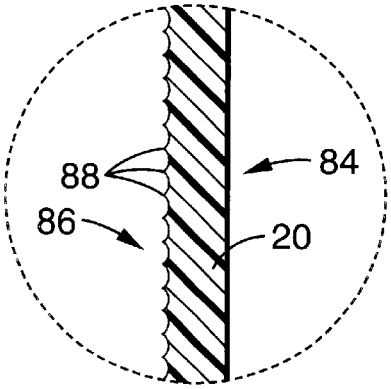
FIG. 4 is an enlarged detail view taken from the cross-sectional portion of FIG. 3 showing the ribs on the non-working surface of the blade.
Figure 5:
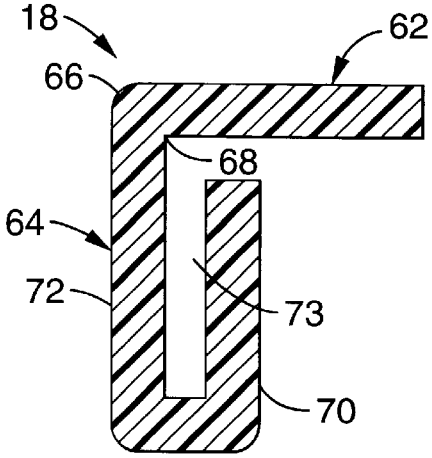
FIG. 5 is a cross-sectional view of the blade base-grasping bracket, alone.

Blade 20 has a working face 84 and a non-working face 86. Working face 84 of blade 20 is that face intended and adapted to be pressed against a wall surface in the use of wipe-down knife 10. Working face 84 is contiguous with the outer surface of the arc of curved hinge 80. Non-working face 86 is the surface of blade 20 opposed to working face 84, i.e. the face contiguous with the inner surface of the arc of curved hinge 80. Working face 84 is smooth-surfaced. In contrast, a plurality of closely-spaced ridges 88 cover substantially the entirety of non-working face 86. Ridges 88 are shown in the enlargement of FIG. 4. The portion of non-working face 86 covered with ridges 88 is identified with the bracket numbered 89 in FIG. 3. Ridges 88 do not cover any portion of the inside or outside arcs of curved hinge 80. Ridges 88 are parallel to working edge 82; they serve to make the planar portion of blade 20 stiffer than the more flexible, non-ridged, curved hinge portion 80. This combination of flexible and less-flexible portions in blade 20 is preferred to achieve the optimum comfortable workability of wipe-down knife 10.

Blade 20 and blade base-grasping bracket 18 are affixed to blade-mounting plate 16 with several blade-fastening screws 90. This is shown in FIGS. 1, 3, 6A and 6B. Blade-fastening screws 90 pass through blade-fastening apertures 92 in blade-mounting plate 16. Cooperating apertures 94 in blade base-grasping bracket 18, and apertures 96 in anchor tab 76 at the base of blade 20, register with apertures 92 in plate 16. Screws 90 are held securely in place through apertures 92, 94 and 96 with button washers 98 at the head-ends of screws 90 and, at their opposed, threaded ends, with nylon-lined, locking hex nuts 100. Locking nuts of the type sold under the Nylock brand name work satisfactorily for this purpose.

The preferred material for construction of blade 20 is polycarbonate plastic. However, other now-known or later-discovered materials may work satisfactorily in construction of blade 20. For example, a thin, spring steel blade may work better than normally expected when incorporated into the apparatus disclosed herein.

It is also contemplated that blades of different sizes constructed in accordance with the foregoing disclosure may be employed for different purposes. Wider blades, and blades with greater distances between their anchor tabs 76 and working edges 82, may all have specific uses. And, a number of these may be kept handy as interchangeable parts of a versatile drywall specialist's toll kit.

Figure 10:
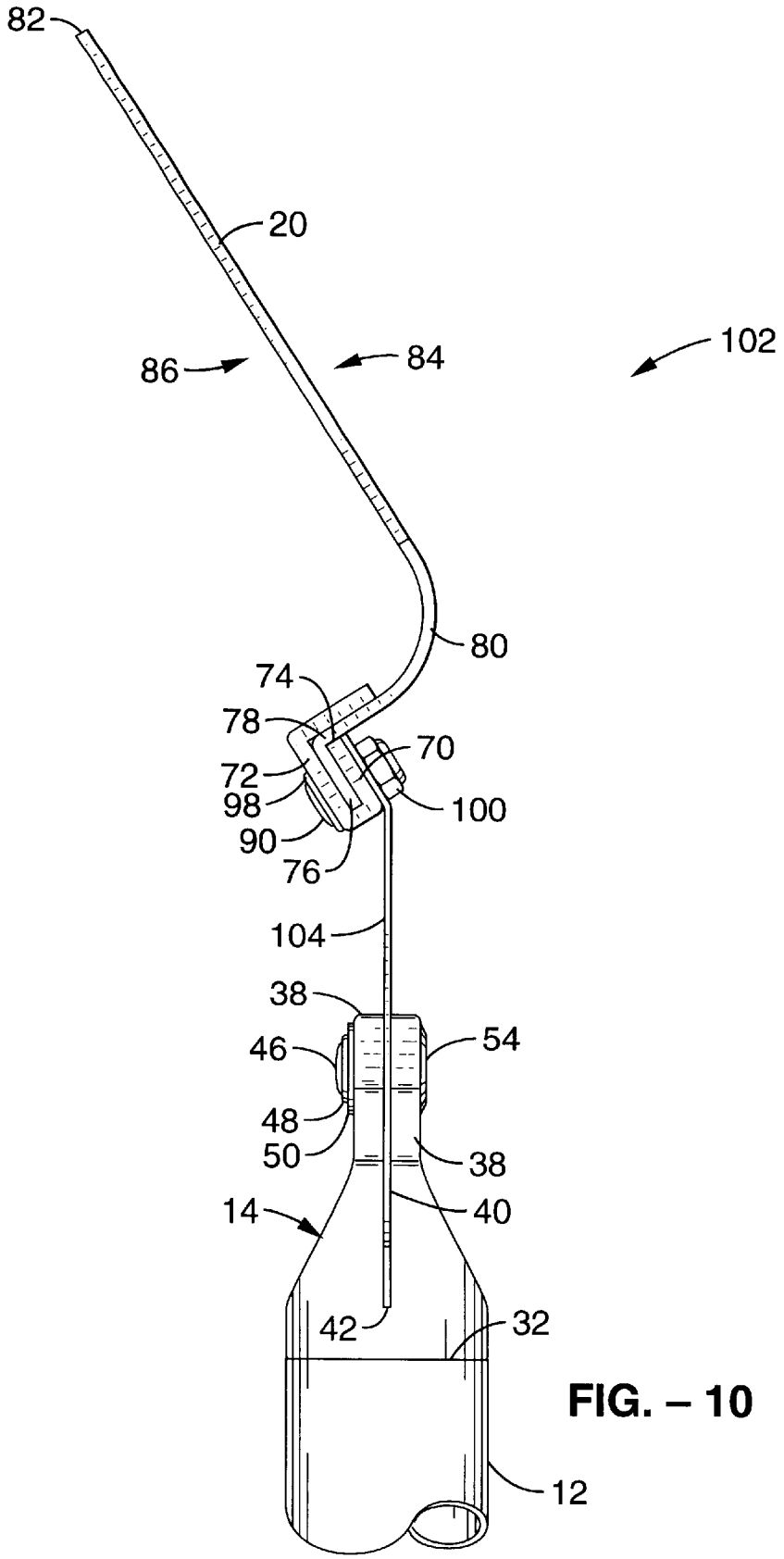
FIG. 10 is a side elevational view of a first alternative embodiment of the wipe-down knife of the invention, having an angled blade-mounting plate.

Although the foregoing disclosure sets forth the construction of a preferred embodiment of the wipe-down knife of the invention, several alternative versions thereof are contemplated. For example, FIG. 10 shows a second embodiment 102 of the invention having a bent, offset, blade-mounting plate 104. Bent plate 104 is very similar to the earlier-disclosed blade-mounting plate 16, except that it is creased along a line transverse to the longitudinal axis of wipe-down knife 102, just below bent plate 104's row of fastening apertures 92. The extent of the offset in bent plate 104 is a matter of choice, but it has been found that a 33-degree bend provides a comfortable average angle for the user. This angle makes it easier for the user to stand back, away from the wall being worked while wiping it down. This embodiment is also more comfortable to use as a spray shield, to cover an object such as a door or window frame next to a wall being sprayed with paint or plaster.

Figure 11:
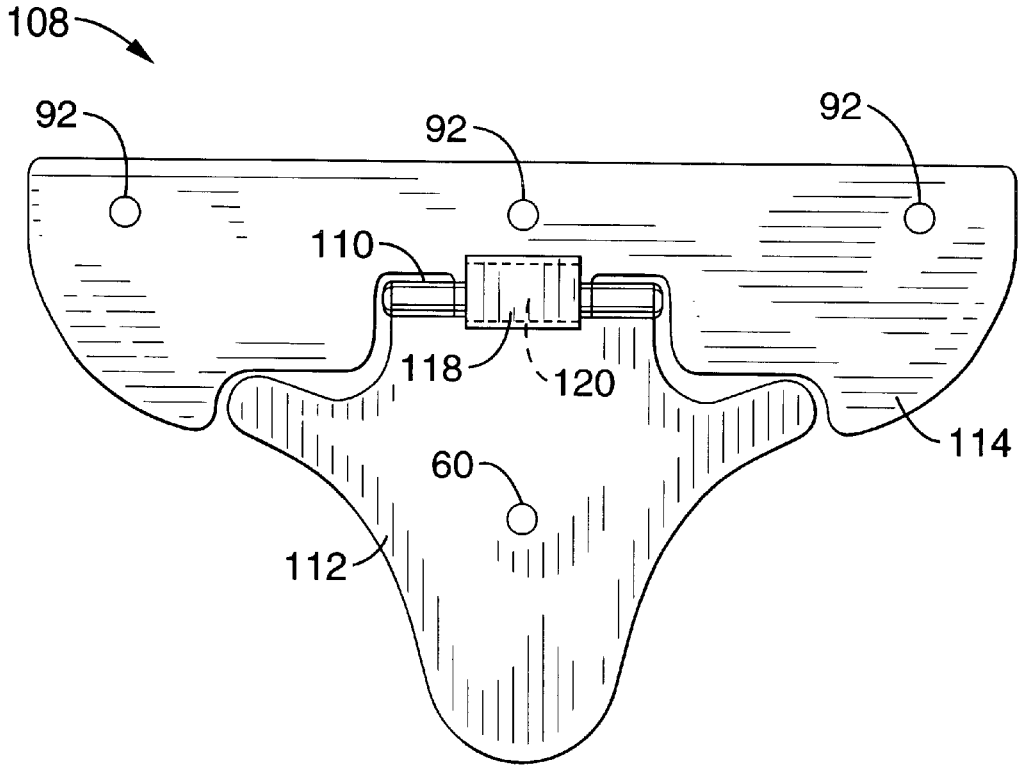
FIG. 11 is a front elevational view of an alternative blade-mounting plate having a hinge incorporated therein.
Figure 12:
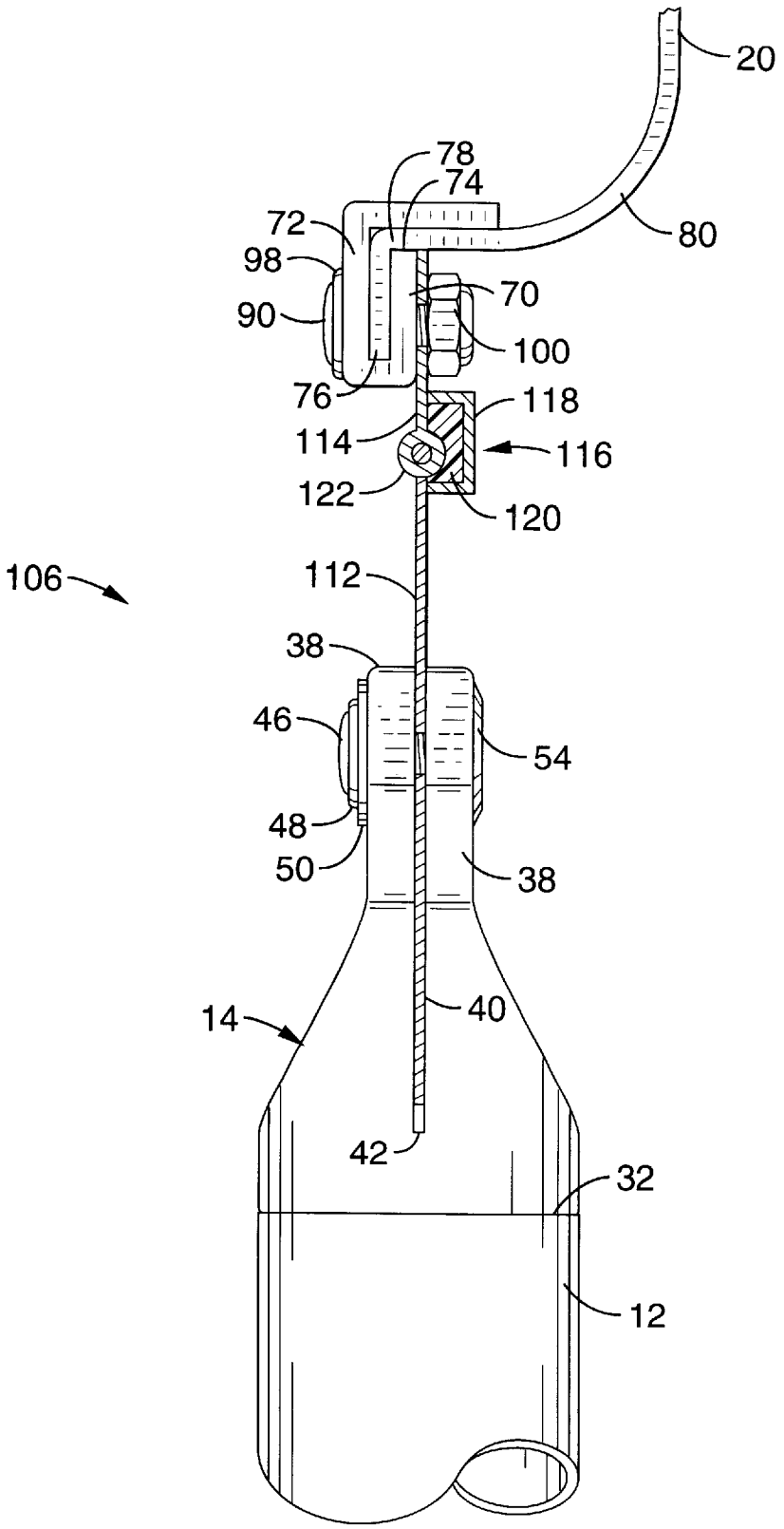
FIG. 12 is an enlarged, fragmentary, partially cross-sectional sectional, side elevational view of the hinged blade-mounting plate of FIG. 11 incorporated into a second alternative wipe-down knife.
Figure 13:
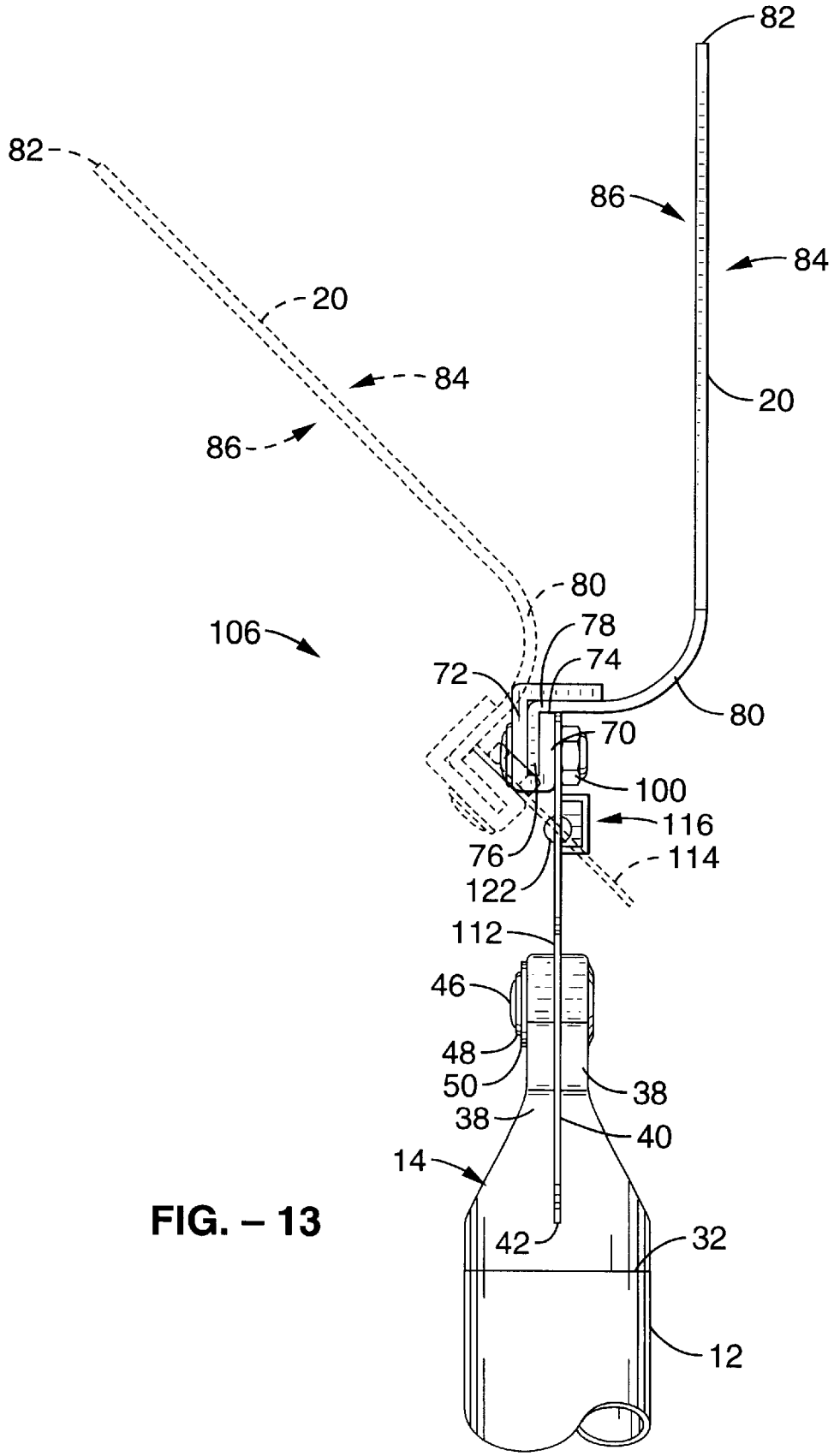
FIG. 13 is a side elevational view of the second alternative wipe-down knife of FIG. 11, showing the hinged blade-mounting plate in a flexed posture.

Yet a third embodiment 106 of the invention is shown in FIGS. 11, 12 and 13. Therein, an alternative, flexible blade-mounting plate 108 is shown to have a butt-type hinge 110 incorporated therein. Flexible plate 108 is comprised of two separate subcomponents: head-engaging portion 112; and, blade assembly-engaging portion 114. These roughly correspond to the lower and upper portions, respectively, of plate 16 shown in FIG. 6A. Hinge 110 connects plate portions 112 and 114.

Hinge 110 further includes a mechanism which permits the user to set plate portions 112 and 114 securely at any desired angle with respect to one another. For example, for wiping-down ceilings and walls, it is most convenient if plate portions 112 and 114 are set at a 33-degree angle. However, for skip troweling a wall, the user needs to be closer to the wall surface, so an 11-degree angle between plate portions 112 and 114 is best for that purpose.

The mechanism that permits portions 112 and 114 at any desired angle is frictional brake 116. As shown in FIG. 12, frictional brake 116 includes a generally rectilinear housing 118 affixed rigidly to head-engaging portion 112 and covering a portion of hinge 110. As is well-known in the art of such hinges, a resilient block 120 resides within housing 118 and impinges upon the knuckle of the opposing hinge portion, i.e. upon knuckle 122 of blade assembly-engaging portion 114. Resilient block 120 should exert sufficient frictional force against the surface of knuckle 122 to permit a user to set a desired angle between plate portions 112 and 114, and to permit that angle to stay fixed during third embodiment 106's intended use. It is contemplated that the frictional force needed to keep plate portions 112 and 114 in place may be different for different purposes. For example, if third embodiment 106 is simply used as a paint shield, a great amount of frictional force is not needed to keep hinge 110 in place. However, for troweling and wiping-down wet plaster and other finishing compounds, greater resistance against displacement of plate portions 112 and 114 will be necessary. Thus, frictional brake may be constructed accordingly.

Further, other known mechanisms may be used to improve the action of the hinged blade-mounting plate of third embodiment 106. For example, plate portions 112 and 114 in third embodiment 106 may be hingedly fastened together with any of a known variety of ratcheting hinges having multiple secure set points throughout a given arc. Hinges of the type having a pair of opposed finger-and-thumb tabs able to be squeezed toward one another against spring pressure to release plates 112 and 114 and let them swivel freely are contemplated. This type of hinge would re-set the angle of plates 112 and 114 securely, once the finger-and-thumb tabs were released.

Figure 2:
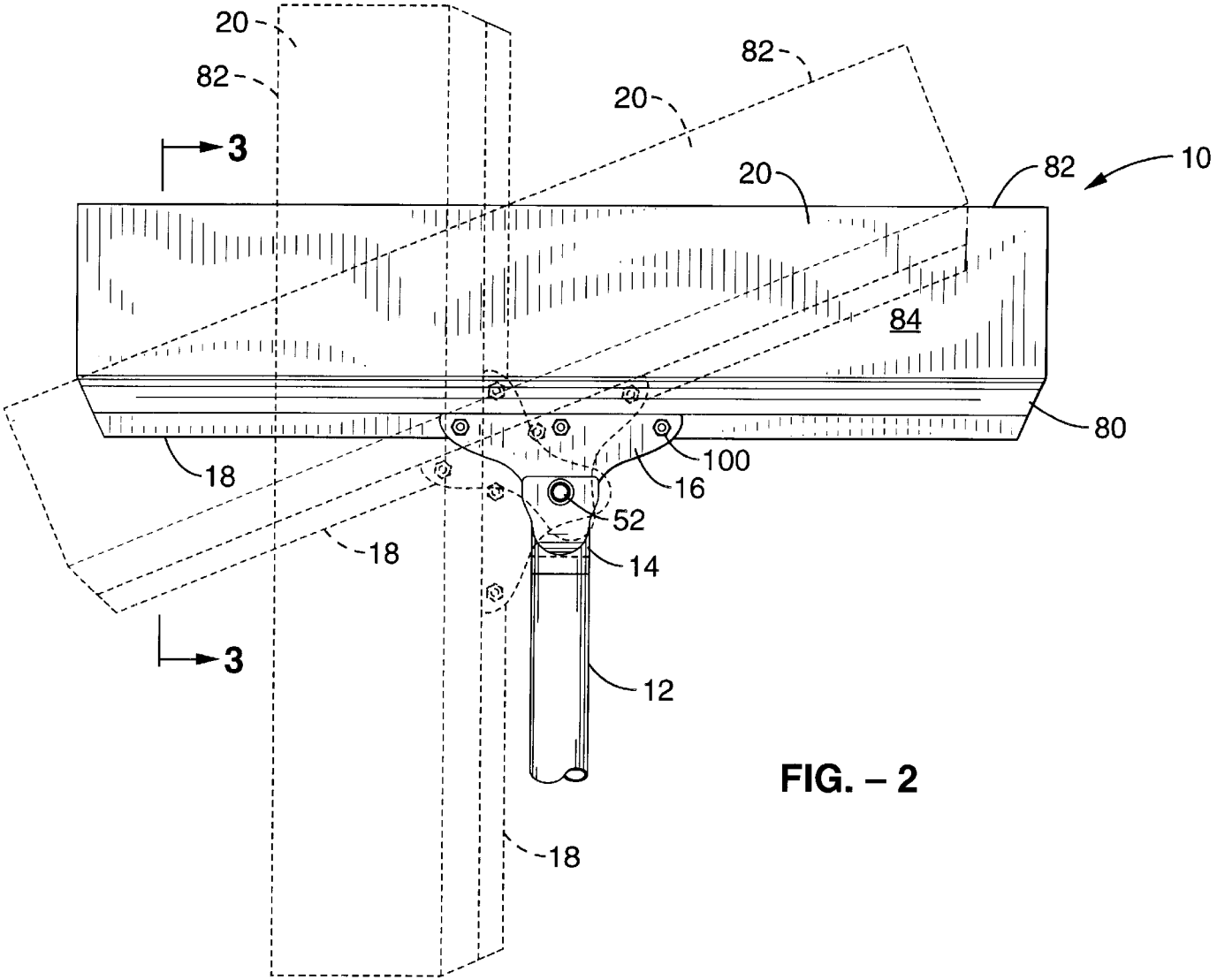
FIG. 2 is a rear elevational view of the wipe-down knife of the invention, showing its working face and showing the range of motion of its blade in dashed lines.
Figure 3:
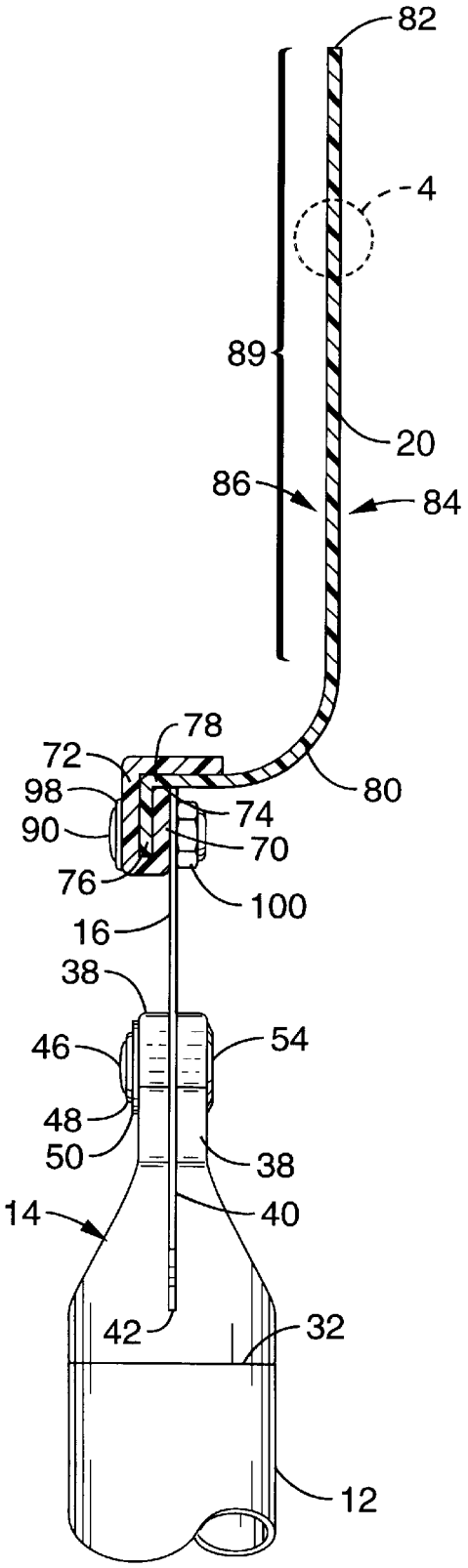
FIG. 3 is a side elevational view, partially in cross-section, of the inventive wipe-down knife as it is shown in FIG. 2, the cross-section being taken on line 3—3.

In use, all embodiments of the inventive wipe-down knife operate similarly in the respect that their blades 20 are able to swivel side-to-side, as shown in FIG. 2. Although FIG. 2 only illustrates the range of blade 20's motion to one side, the construction disclosed herein makes blade 20 able to travel between two fully-opposed positive-stop positions on opposite sides of handle shaft 12.

The foregoing detailed disclosure of the inventive wipe-down knife in its various embodiments is considered as only illustrative of the preferred embodiment of, and not a limitation upon the scope of, the invention. Neither is its identification as a "wipe-down knife" herein intended to limit the scope of the claims or the invention. Those skilled in the art will envision many other possible variations of the structure disclosed herein that nevertheless fall within the scope of the following claims. For example, different materials may be used in construction of the invention, and all of its elements may be fashioned in different sizes to suit certain purposes.

And, alternative uses for this inventive apparatus may later be realized. For example, in arts or crafts where a spray shield of any type is necessary, the apparatus herein may be used beneficially. And, it would also be a helpful tool in any practice or profession which requires pastey or plastic substances to be spread over a surface or smoothed-out. Yet further, head 14 may be useful for a wider range of purposes than disclosed herein. Indeed, in any case where a planar member must be supported on the end of a handle shaft, use of head 14 may yield superior results. Accordingly, the scope of the invention should be determined with reference to the appended claims, and not by the examples which have herein been given.

What is claimed is:

1. A blade base-grasping bracket for a wipe-down knife, comprising:

a. a first planar panel projecting in a first plane perpendicular to a longitudinal axis of said bracket; and, b. a second planar panel, integral with said first panel at an apex, projecting in a second plane perpendicular to said bracket's longitudinal axis, said second plane also being generally perpendicular to said first plane, whereby said bracket has a generally L-shaped cross section, wherein said second panel of said bracket projects farther from said apex than said first panel and is folded back toward an interior angle of said apex, such that said folded-back portion of said farther-projecting second panel is parallel to, but spaced apart from, a portion of said second panel which is closer to said apex, thus defining a slot-shaped space therebetween, and wherein a terminal end edge of said folded-back portion of said second panel falls short of abutting said first panel.

2. A blade assembly for a wipe-down knife, comprising:

a. an elongate blade base-grasping bracket having a generally L-shaped cross-section comprised of first and second planar panels projecting from an apex, wherein said second panel of said bracket projects farther from said apex than said first panel and is folded back toward an interior angle of said apex, such that said folded-back portion of said farther-projecting second panel is parallel to, but spaced apart from, a portion of said second panel which is closer to said apex, thus defining a slot-shaped space therebetween, and wherein a terminal end edge of said folded-back portion of said second panel falls short of abutting said first panel; and, b. a blade comprising:

i. an anchor tab at a base of said blade, said tab being adapted to be received securely within said slot-shaped space bound by opposed inner surfaces of said folded-back second panel of said blade base-grasping bracket;

ii. a right-angled nesting portion, integral with and directly adjacent to said anchor tab, adapted to seat nestingly against said interior angle of said apex of said blade base-grasping bracket;

iii. a curved hinge portion integral with and directly adjacent to said right-angled nesting portion; and, iv. a working edge portion integral with and directly adjacent to said curved hinge portion.

3. The blade assembly of claim 2, wherein said blade base-grasping bracket and all portions of said blade have substantially the same width.

4. The blade assembly of claim 2, wherein said blade has a substantially uniform thickness throughout.

5. The blade assembly of claim 2, wherein said blade has a plurality of elongate thickened portions parallel to said working edge.

6. The blade assembly of claim 2, wherein said working edge portion of said blade has a working face and a non-working face, and wherein said non-working face includes a plurality of ribs parallel to said working edge.

7. The blade assembly of claim 2, wherein all surfaces of said blade have an axis which is substantially parallel to the length of said blade base-grasping bracket.

8. A wipe-down knife, comprising:

a. a handle having a longitudinal axis, a proximal end and a distal end;

b. a blade comprising a first planar portion and a second planar portion, said second planar portion being disposed to said first planar portion such that said blade has an L-shaped cross-section;

c. means for mounting said blade to said handle's distal end such that said first planar portion of said blade is moveable between being disposed transverse to said handle's longitudinal axis and being disposed substantially parallel to said handle's longitudinal axis, and wherein said second planar portion is disposed such that, as said blade is moved, said second planar portion remains parallel to said handle's longitudinal axis.

9. A wipe-down knife, comprising:

a. a handle having a proximal end and a distal end;

b. a head at said distal end of said handle, said head having a longitudinal axis, said head also having a slot therein which is open at a distal end of said head and disposed in a plane parallel to said head's longitudinal axis;

c. a blade mounting plate disposed swivelingly in said slot in said head;

d. a blade mounted upon said blade mounting plate, said blade having a first planar portion which is affixed to said blade mounting plate and which, as said blade mounting plate is swiveled in said slot, is moveable between being disposed transverse to said head's longitudinal axis and being disposed parallel to said head's longitudinal axis, said blade also having a second planar portion which is disposed distally and which, as said blade mounting plate is swiveled in said slot, remains parallel to said head's longitudinal axis.

10. The wipe-down knife of claim 9, wherein said blade mounting plate is T-shaped.

11. The wipe-down knife of claim 9, wherein said blade is mounted upon said blade mounting plate with a blade base-grasping bracket.

12. The wipe-down knife of claim 11, wherein said blade base-grasping bracket comprises:

a. a first planar panel projecting in a first plane perpendicular to a longitudinal axis of said bracket; and, b. a second planar panel, integral with said first panel at an apex, projecting in a second plane perpendicular to said bracket's longitudinal axis, said second plane also being generally perpendicular to said first plane, whereby said bracket has a generally L-shaped cross section, wherein said second panel of said bracket projects farther from said apex than said first panel and is folded back toward an interior angle of said apex, such that said folded-back portion of said farther-projecting second panel is parallel to, but spaced apart from, a portion of said second panel which is closer to said apex, thus defining a slot-shaped space therebetween, and wherein a terminal end edge of said folded-back portion of said second panel falls short of abutting said first panel.

13. A head for a wipe-down knife, comprising:

a. means for engaging a support for a wipe-down knife blade; and, b. means for mounting said head securely in an open end of a tubular handle, wherein said tubular handle-engaging means includes means for engaging an end edge of a tubular handle, and further includes means adapted to seat deep within said tubular handle and to brace against an inner surface of said tubular handle in response to radially-directed force against said means for engaging a support for a wipe-down knife.

14. The head of claim 13, wherein said means for engaging an end edge of a tubular handle comprises a slightly tapered portion of said head, shaped and dimensioned for secure frictional engagement with a portion of an inner surface of said tubular handle immediately adjacent to said end edge of said tubular handle when said head is driven axially toward said handle, said means for engaging an end edge of a tubular handle further comprising a step adapted to abut said end edge of said tubular handle when said head is driven axially toward said handle.

15. The head of claim 13, wherein said means adapted to seat deep within said tubular handle comprises an elongate lever arm including a plurality of radially-projecting shoes at said lever arm's end, each shoe being adapted to brace against a different portion of said inner surface of said tubular handle in response to differently-directed radial force against said means for engaging a support for a wipe-down knife.

16. The head of claim 15, wherein said lever arm is cruciform in cross-section, being comprised of four elongate, generally rectangular components, each rectangular component projecting radially at a right angle to its two most closely adjacent components, and each bearing one of said radially-projecting shoes on an outermost, endmost edge.

17. A head for a wipe-down knife, comprising:

a. means for engaging a support for a wipe-down knife blade, wherein said blade support-engaging means includes means for permitting a support for a wipe-down knife blade to rotate through a planar arc; and, b. means for mounting said head securely in an open end of a tubular handle.

18. A head for a wipe-down knife, comprising:

a. means for engaging a support for a wipe-down knife blade, wherein said blade support-engaging means comprises a yoke having a pair of parallel pads and a transverse pivot pin through said pads; and, b. means for mounting said head securely in an open end of a tubular handle.

19. The head of claim 18, further including selectively adjustable means for drawing said yoke's pads closer to one another, whereby said pads may be caused to impinge upon a blade support disposed therebetween.

20. The head of claim 19, wherein said selectively adjustable means for drawing said yoke's pads closer to one another comprises a pivot pin including a threaded portion projecting past an outer surface of a pad of said yoke; a tension-retaining washer engaged with said pin's threaded portion; and, a threaded nut adapted for engagement with said pivot pin.

21. A head for a wipe-down knife, comprising:

a. means for engaging a support for a wipe-down knife blade, wherein said support-engaging means comprises a planar slot in a distal end portion of said head, and further, wherein said slot defines and separates a pair of projections projecting from said head, said support engaging means further comprising aligned, fastener-receiving apertures transverse to said slot and through said projections; and, b. means for mounting said head securely in an open end of a tubular handle.

22. The head of claim 21, wherein each said projection is generally planar and includes a widened portion at its distal end.

* * * * *